US006404385B1

(12) United States Patent
Croq et al.

(10) Patent No.: US 6,404,385 B1
(45) Date of Patent: Jun. 11, 2002

(54) TELECOMMUNICATION SYSTEM ANTENNA AND METHOD FOR TRANSMITTING AND RECEIVING USING THE ANTENNA

(75) Inventors: Frédéric Croq, Tournefeuille; Florence Dolmeta, Cugnaux; Philippe Voisin, Tournefeuille; Didier Casasoprana, Saint Germain en Laye, all of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/446,418

(22) PCT Filed: Jun. 25, 1998

(86) PCT No.: PCT/FR98/01347

§ 371 (c)(1),
(2), (4) Date: Feb. 15, 2000

(87) PCT Pub. No.: WO99/00868

PCT Pub. Date: Jan. 7, 1999

(30) Foreign Application Priority Data

Jun. 26, 1997 (FR) ..... 97 08014

(51) Int. Cl.[7] ..... H01Q 3/00
(52) U.S. Cl. ..... 342/359; 343/757
(58) Field of Search ..... 342/74, 75, 359; 343/757

(56) References Cited

U.S. PATENT DOCUMENTS 3,878,520 A * 4/1975 Wright et al. ..... 343/854
4,837,576 A * 6/1989 Schwarz ..... 342/77
5,223,845 A * 6/1993 Eguchi ..... 342/359
5,225,839 A 7/1993 Okurowski et al.
5,296,862 A * 3/1994 Rodeffer et al. ..... 342/359
5,303,240 A * 4/1994 Borras et al. ..... 370/95.3
5,351,060 A * 9/1994 Bayne ..... 343/766
5,463,400 A 10/1995 Tayloe
5,680,141 A * 10/1997 Didomenico et al. ..... 342/372

FOREIGN PATENT DOCUMENTS

| | | |
|---|---|---|
| GB | 2 253 520 A | 9/1992 |
| WO | WO 97/03367 | 1/1997 |
| WO | WO 97/15092 | 4/1997 |
| WO | WO 99/00868 | 1/1999 |

* cited by examiner

*Primary Examiner*—Dao Phan
(74) *Attorney, Agent, or Firm*—Sughrue Mion, PLLC

(57) ABSTRACT

A telecommunications system antenna for communicating, in transmission and in reception, with a large area whose position relative to the antenna varies. The antenna has motors (80, 82) for pointing the antenna towards the area and radiating elements (74, 76) associated with a control device for modifying the antenna's radiation pattern according to the relative position of the antenna and the area. When the antenna is installed on a telecommunications satellite, as the antenna moves, the antenna can remain constantly in communication with an area of the Earth covering several hundred kilometers.

14 Claims, 3 Drawing Sheets

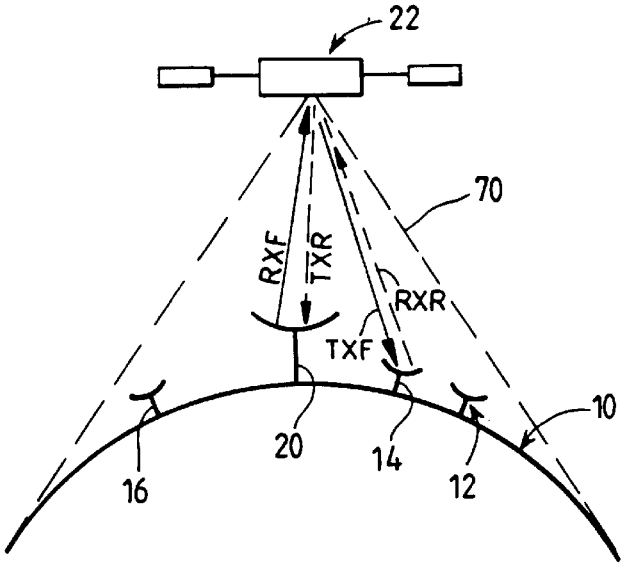
FIG.1
FIG.2
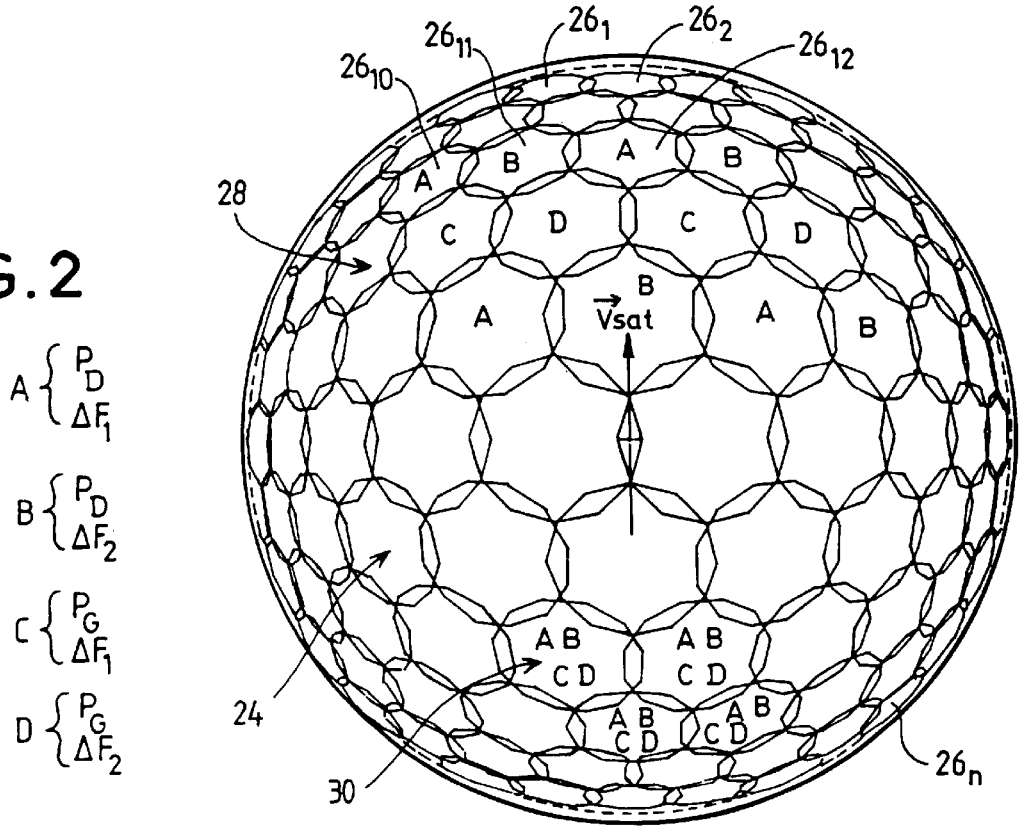

TELECOMMUNICATION SYSTEM ANTENNA AND METHOD FOR TRANSMITTING AND RECEIVING USING THE ANTENNA

BACKGROUND OF THE INVENTION

The present invention relates to an antenna for a telecommunications system, in particular a satellite telecommunications system.

Diverse applications often require antennas to receive signals from a mobile source or to transmit signals to a mobile receiver (target). Such transmit and/or receive antennas are usually active antennas made up of immobile radiating elements in which the direction of the radiation pattern can be varied by varying the phase of the signals feeding the radiating elements.

That technique cannot achieve satisfactory radiation patterns for high squint angles, i.e. for directions departing significantly from the mean transmit and/or receive direction.

A source or a receiver can be tracked using motors driving a conventional antenna.

Neither of the above two types of antenna provides a total solution to the problem of communication between the antenna and a plurality of sources or receivers in a large area, in particular an area on the ground, within which communication has to be confined despite the changing position of the antenna relative to the area.

In particular, this problem arises in a telecommunications system using a network of satellites in low Earth orbit. A system of this kind has already been proposed for high bit rate communication between fixed or mobile terrestrial stations within a particular geographical area covering several hundred kilometers. The altitude of the satellites is in the range from 1000 km to 1500 km.

In such systems, each satellite includes groups of receive and transmit antennas and each group is dedicated to a given area on the ground. Within each group, the receive antennas receive the signals from a station in the area and the transmit antennas relay the received signals to another station in the same area. As the satellite moves, the antennas of a group point towards the area at all times so long as the area remains within the field of view of the satellite. Accordingly, for each satellite, a region of the Earth is divided into n areas, and when the satellite moves over a region, a group of transmit and receive antennas is allocated to each area and points toward that area at all times.

In this way, switching from one antenna to another while the satellite is moving over a region, which takes around twenty minutes, for example, and which could be prejudicial to the speed or the quality of communication, is avoided because only one group of transmit and receive antennas is allocated to the area.

Furthermore, the low altitude of the satellites minimizes propagation times, which is favorable to interactive communications, especially for "multimedia" applications.

Clearly, with this telecommunications system, an antenna for one area must not suffer interference from signals from another area and must not interfere with other areas itself.

SUMMARY OF THE INVENTION

To solve the above problem of isolating large areas, the invention provides an antenna that can be steered mechanically by drive means and further comprises radiating elements whose radiation pattern is modified as a function of the orientation of the antenna relative to the target or source area to match the pattern to the shape of the target or source area as seen by the antenna.

Accordingly, in the case of the satellite telecommunications system described above, in which the areas are all circular, an antenna on the satellite sees the area as a circle when the satellite is at the nadir of the area. However, as the satellite moves away from that position, the antenna sees the area as an ellipse. The radiating elements, and the control means therefor, which adapt the radiation pattern to the shape of the area as seen by the antenna, then prevent the antenna from receiving signals from other areas or transmitting signals to adjacent areas.

The transmit and receive radiating elements are preferably on a common panel moved by the same drive means.

The pattern is modified by modifying the amplitudes of the signals fed to the radiating elements.

Moreover, in an advantageous embodiment of the invention the radiating elements are disposed on a surface whose shape substantially corresponds to the required radiation pattern for the most distant areas, targets or sources, i.e. the sources supplying the lowest signal levels or the targets to which it is necessary to transmit the maximum power. In other words, the radiating elements adapt to the worst-case scenario.

BRIEF DESCRIPTION OF THE DRAWING

Other features and advantages of the invention will become apparent from the following description of some embodiments of the invention given with reference to the accompanying drawings, in which:

FIG. 1 is a diagram showing a telecommunications system linking terrestrial mobiles or stations using a system of satellites, FIG. 2 is a diagram showing one distribution of traffic in the context of the telecommunications system to which the invention applies.

DETAILED DESCRIPTION OF THE INVENTION

Figure 3:
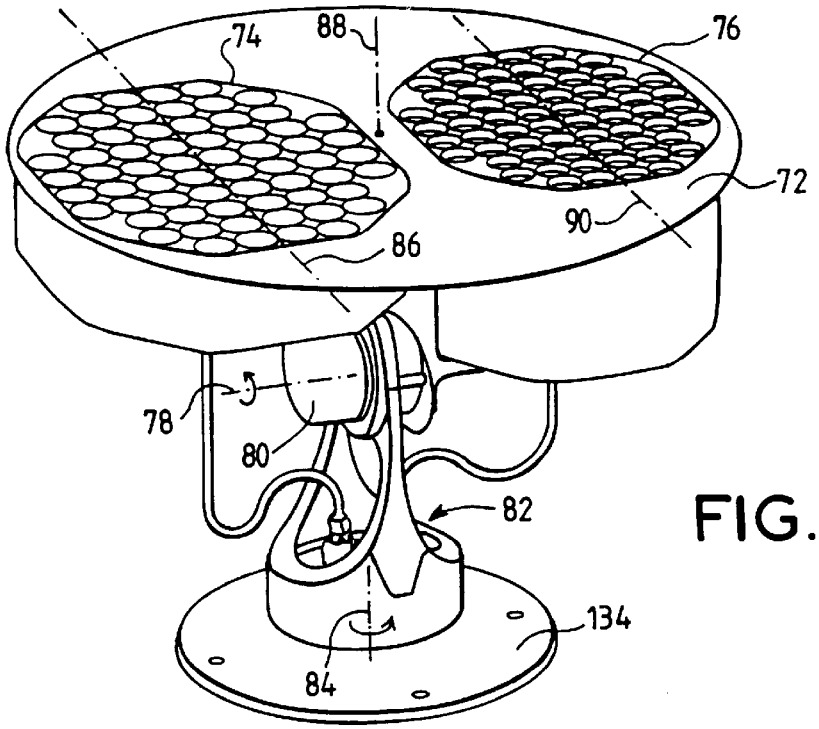
FIG. 3 is a diagram showing a transmit and receive antenna in accordance with the invention mounted on a satellite.

The example to be described concerns a telecommunications system using a constellation of satellites in low Earth orbit at an altitude of approximately 1300 km above the surface 10 of the Earth (FIG. 1).

The system has to set up calls between users 12, 14, 16 via one or more connecting stations 20. It also sets up calls between users and service providers (not shown) connected to a connection station. These calls are handled by a satellite 22.

Four types of signal are used in calls between, on the one hand, the users 12, 14, 16 and the connection station 20 and, on the other hand, the satellite 22, namely: signals TXF from the satellite 22 to the users, signals RXR from the users 12, 14, 16 to the satellite 22, signals TXR from the satellite 22 to the connection station 20 and signals RXF from the connection station to the satellite 22. It should be mentioned here that the suffix F means "forward" (the direction from the connection station to the users) and R means "return" (the direction from the users to the connection station). Also, in the conventional way, TX means "transmit" and RX means "receive". Here transmission and reception are defined relative to the satellite.

In the above system, the satellite 22 sees a region 24 of the Earth at all times (FIG. 2), and that region is divided into areas $\mathbf{26}_1$, $\mathbf{26}_2$, . . . , $\mathbf{26}_n$. In one example, each region 24 includes 36 areas (n=36).

Each area $\mathbf{26}_i$ is a circle with a diameter of approximately 700 km. Each region 24 is delimited by a cone 70 centered on the satellite and with an angle at the apex determined by the altitude of the satellite. A region is therefore a part of the Earth visible from the satellite. When the altitude of the satellite is 1300 km, the angle at the apex is approximately 104°.

The satellite has groups of transmit and receive antennas allocated to each area 26. Each group continues to point towards the same area as the satellite moves. In other words, the radiation pattern of each antenna is always directed towards the same terrestrial area $\mathbf{26}_i$, in theory for as long as the satellite can see that area. The maximum demand in terms of antennas is 4n: four types of signal per area. However, according to the invention the total number of antennas is significantly less than 4n (as explained below).

The satellite provides communication between users and between the connection station and users within each area $\mathbf{26}_i$. On the other hand, communication between areas is provided by terrestrial means, for example using cables between the connection stations of the various areas that form part of the same region or different regions.

The number and the disposition of the satellites are such that an area $\mathbf{26}_i$ sees two or three satellites at all times. In this way, when an area $\mathbf{26}_i$ moves out of the field of vision of the satellite handling calls in that area, there is a satellite ready to take over from it and the call is switched from one satellite to the other instantaneously. However, such switching occurs relatively infrequently, for example approximately every twenty minutes, because an antenna continues to point towards the same area at all times. In practice, switching occurs when the elevation of the satellite drops below 10° for the area $\mathbf{26}_i$ in question.

In the example to which the invention applies, at least two categories of areas corresponding to different traffic demand are provided within a region 24. The traffic demand is measured in terms of the average quantity of data transmitted per unit time and per unit surface area, for example.

Thus, in a part 28 of the region 24 (FIG. 2) there is relatively little traffic demand whereas in another part 30 the traffic demand is high. High traffic demand corresponds to urban areas of a developed country, for example, and low traffic demand corresponds to rural or relatively undeveloped areas, for example.

All the signal resources A, B, C, D are allocated to each area in the high traffic part 30.

The expression "signal resources" means a polarization characteristic and a carrier frequency band characteristic.

In this example, the polarization is either right circular ($P_D$) or left circular ($P_G$) and two separate carrier frequency bands are used: $\Delta F_1$ and $\Delta F_2$.

In FIG. 2, A signifies right circular polarization $P_D$ and a frequency band $\Delta F_1$, B signifies right circular polarization $P_D$ and a frequency band $\Delta F_2$, C corresponds to left circular polarization PG and a frequency band $\Delta F_1$ and D to left circular polarization $P_G$ and a frequency band $\Delta F_2$.

Thus, in the high traffic part 30, each area is allocated all of the resources A, B, C and D.

In the low traffic part 28, on the other hand, each area is allocated only one resource A, B, C or D. Also, the distribution of the signal resources is such that two adjacent areas do not have identical resources. The areas to which the same resource is allocated are separated by at least one area in which the resource is different. Accordingly, the area $\mathbf{26}_{10}$ allocated resource A (right circular polarization $P_D$ and band $\Delta F_1$) is separated from the area $\mathbf{26}_{12}$ having the same resource by the area $\mathbf{26}_{11}$, allocated resource E (right circular polarization $P_D$, frequency band $\Delta F_2$).

Note that the carrier frequency bands $\Delta F_1$ and $\Delta F_2$ have the same width or different widths. The carrier frequency band $\Delta F_2$ is wider than the carrier frequency band $\Delta F_1$ if some areas in part 28 have a heavier traffic demand than other areas, for example.

This separation of the region 24 into low traffic areas and high traffic areas optimizes the equipment on the satellite 22 (as explained below).

In an area like the area $\mathbf{26}_{10}$, the antennas can receive or transmit only right circular polarization $P_D$ signals. Simpler equipment can then be used. In the areas of the part 30, on the other hand, the antenna systems must be capable of generating both circular polarizations (right and left), without interference between the signals.

With reference to the constraints on the equipment on the satellite 22, each antenna tracks an area and must sweep an angle in the range from 100° to 120° between the area entering the field of view of the satellite and leaving it. Furthermore, the shape of the radiation pattern must vary as the satellite moves because the antenna sees an area vertically below the satellite with no deformation, i.e. as a circle, whereas it sees an area at the end of the region, for example the area $\mathbf{26}_1$ or $\mathbf{26}_2$, as a smaller elongate ellipse. Because all communications possibilities must be retained for each area as the satellite moves across the region, it is necessary to be able to sweep the antennas as necessary and to control the radiation patterns as a function of the target direction.

To achieve this in the embodiment described, the low traffic areas are allocated active antennas, i.e. antennas which can be pointed and reconfigured electronically, and antennas that can be pointed mechanically and reconfigured electronically are allocated to high traffic areas. Alternatively, all areas are allocated antennas of the latter type.

The following description refers only to antennas which are steered mechanically and whose radiation pattern is modified electronically.

Such antennas provide the best isolation between areas because they are pointed mechanically. However, an antenna of this type can be allocated to only one area. It is therefore necessary to provide at least as many antennas of this type as there are high traffic areas.

For example, there are eight to twelve high traffic areas per region and sixteen to twenty-four low traffic areas.

FIG. 3 shows an antenna for high traffic areas. It handles transmission and reception.

The antenna includes a plate 72 accommodating two panels of radiating elements 74 and 76. The panel 74 is for transmission and the panel 76 is for reception.

The support plate 72 is shown as horizontal in FIG. 3 and is pivoted about a horizontal axis 78 parallel to the plane of the plate 72 by an elevation motor 80, rotation about the axis 78 pointing it in elevation.

Another motor 82 with a vertical axis 84 is provided under the motor 80. Rotation about the axis 84 orients the plate in azimuth.

The panel 74 of transmit radiating elements is generally elliptical with a major axis 86. This elliptical shape corresponds to the shape of an area close to the horizon as seen by the antenna when the antenna is pointed towards that area, i.e. when the vertical axis 88 of the plate 72 is directed toward the area adjoining the horizon.

To be more precise, the elliptical shape is matched to the shape of an area to be covered corresponding to a pointing angle of approximately 50° when the maximum pointing angle is 54°. The axis 86 is perpendicular to the major axis of the ellipse as which an area is seen for a pointing angle of 50°.

The foregoing description clearly refers to vertical and horizontal directions in order to indicate the relative directions of the various components and not to indicate any absolute orientation.

Like the panel 74, the receive panel 76 is generally elliptical with a major axis 90 parallel to the major axis 86 of the panel 74.

The panel 74 handles both TXF signals and TXR signals. Similarly, the panel 76 handles RXF and RXR signals.

Figure 4:
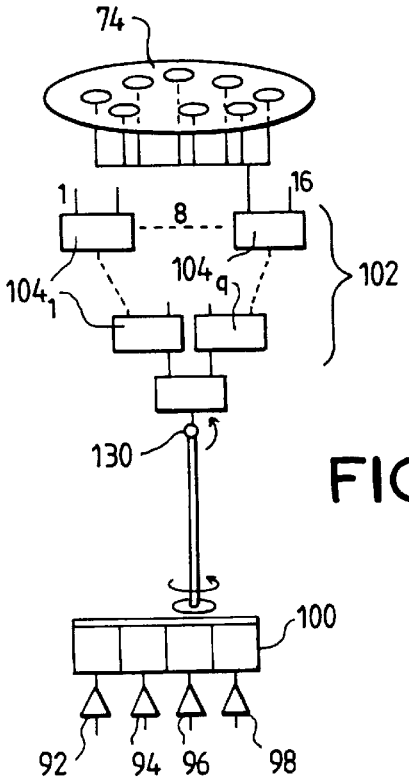
FIG. 4 is a diagram showing how a transmit antenna from FIG. 3 is controlled.

FIG. 4 is a diagram of a control circuit for the transmit panel 74. In this example there are three carrier frequency sub-bands for TXF signals (transmission towards users) and a single carrier frequency band for the TXR signals (toward the connection station). Accordingly, three amplifiers 92, 94 and 96 are allocated to the TXF signals and one amplifier 98 is provided for the TXR signals.

The FIG. 4 circuit is obviously not limited to this division into three sub-bands for the TXF signals and one band for the TXR signals. Other divisions are feasible, for example two bands for the TXF signals and two bands for the TXR signals.

The outputs of the amplifiers 92 through 98 are fed to the inputs of a multiplexer 100 which delivers signals to the radiating elements of the panel 74 via a beam-forming circuit or network 102.

In accordance with one feature of the invention, the network 102 matches the radiation pattern to the position of the satellite relative to the area to which the antenna is allocated. In other words, the axis 88 is pointed towards the corresponding area at all times by the azimuth motor 82 and the elevation motor 80 (FIG. 5), and this "mechanical", pointing is associated with electronic control 102 to match the beam to the relative position of the antenna and the area.

The beam is of circular section when the satellite is at the nadir of the area and of elliptical section when the area adjoins the horizon. To this end, and for transmission in particular, when the antenna is at the nadir only radiating elements arranged in a circle are energized; when the satellite leaves the nadir of the area, the amplitudes of the signals fed to the transmit radiating elements are controlled in order to activate other radiating elements progressively, the maximum number of radiating elements being activated when the antenna is about to lose sight of the area.

In the example, the circuit 102 includes q power distributors $\mathbf{104}_1$ through $\mathbf{104}_q$. These distributors are reconfigurable; they are low-loss devices because they are on the output side of the amplifiers 92 through 98.

The power distributors $\mathbf{104}_i$ allocate the amplitude of the signals supplied to the radiating elements of the panel 74 but not their phase. The radiating elements are not involved in pointing; it is therefore not necessary to vary the phase of the signals applied to them.

Also, it has been found that it is not necessary to control the amplitude of each radiating element individually. This is why, in one embodiment of the invention, the number q of power distributors is a sub-multiple of the number of radiating elements. In this example the number of radiating elements is 64 or 80 but the number q is 16.

This simplification stems from the observation that the radiation pattern is axisymmetrical relative to the direction of mechanical pointing of the panel. Under these conditions, the radiating elements at the same distance from the center of the panel are excited with the same amplitude and can therefore be excited in the same manner, i.e. by the same components.

Figure 4A:
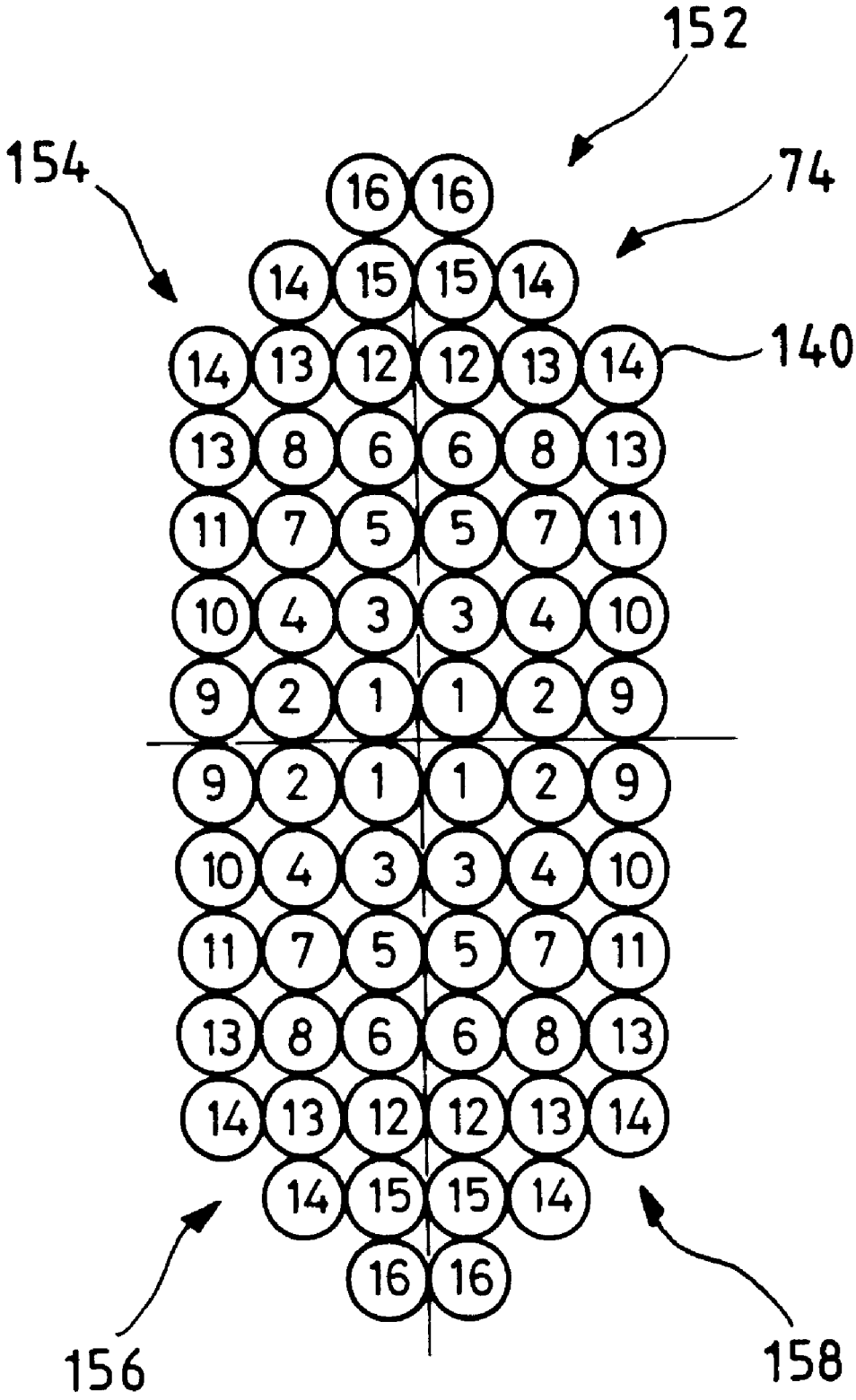
FIG. 4*a* is a diagram showing a radiating panel.

FIG. 4*a* shows one example of a panel of radiating elements disposed in an elongate shape. Each radiating element is represented by a circle 140. A number, or index, from 1 to 16 is shown inside each radiating element. Identical numbers correspond to excitation with the same amplitude. Accordingly, for example, the four elements of index 1 at the center are all excited with the same amplitude. FIG. 4*a* also shows that the radiating elements are generally divided between four quadrants 152, 154, 156 and 158 which are excited in the same manner.

Figure 5:
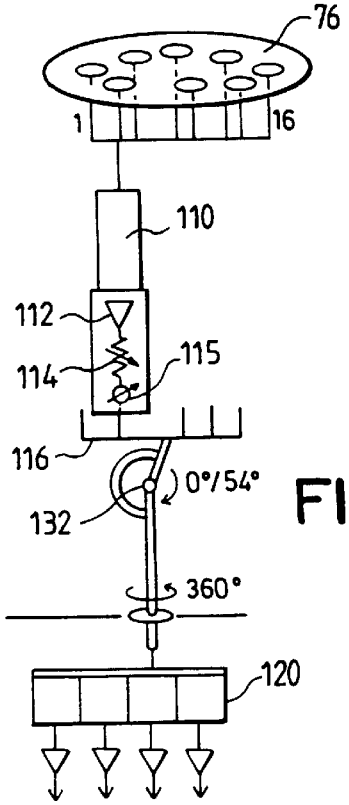
FIG. 5 is a diagram showing how a receive antenna from FIG. 5 is controlled.

FIG. 5 shows the circuit for processing the signals received by the panel of radiating elements 76 allocated to reception.

This circuit includes filters 110, low-noise amplifiers 112, variable attenuators 114 and variable phase-shifters 115. The function of the attenuators 114 and the phase-shifters 115 is the same as that of the attenuators 104 from FIG. 4, namely matching the radiation pattern to the position of the satellite relative to the area. The use of phase-shifters in the receiver optimizes beam shaping; it does not penalize the link balance because the phase-shifters are on the output side of the low-noise amplifiers 112.

As in FIG. 4, the attenuators 114 and the phase-shifters 115 are controlled in accordance with the position of the satellite relative to the area.

A passive combiner 116 adds the signals supplied by the attenuators 114 and the phase-shifters 115.

The output signals of the combiner 116 are fed to a multiplexer 120 which separates the RXF and RXR signals. In this example, there are three RXF signal bands and one RXR signal band, in a similar manner to the FIG. 4 example.

Of course, and also as in the FIG. 4 example, the distribution of the RXF and RXR signal bands can be different.

Note that, as shown in FIGS. 3, 4 and 5, the cables or electrical conductors pass through a rotary seal 130, 132 and that these cables are subject to rotations corresponding to the adjustments in elevation and in azimuth.

The radiation pattern is reconfigured as a function of the elevation by a beam-forming network based on ferrite or MMIC (Monolithic Microwave Integrated Circuits). A ferrite-based circuit is preferably used for the transmit antenna, a circuit of this kind being better suited to forming low-loss beams after power amplification. The power amplification is provided by SSPA which have a low efficiency and therefore dissipate a large amount of heat. It is therefore preferable to have this circuit far away from the panel 72, which generally has limited heat dissipation means; the circuit is therefore installed under the "Earth" panel 134 (FIG. 3), which is always pointed toward the center of the Earth and has greater heat dissipation means.

The receive beam-forming network uses the MMIC technology. The low-noise amplifiers are disposed near the radiating panel to minimizes $I^2R$ losses due to the connections.

Mechanical pointing of the plate 72 is particularly advantageous, as compared to electronic pointing, because it is not necessary to use oversize panels of radiating elements 74 and 76.

The absence of electronic pointing makes best possible use of the signal resources to form the beams over a wide bandwidth. In particular, because of the absence of electronic pointing, there is no frequency dispersion associated with the absence of phase slope for pointing.

The pitch of the array of radiating elements can be in the order of 0.9λ. This easily prevents the formation of array lobes. Furthermore, this distance between adjacent radiating elements facilitates laying out the various control elements and limits coupling. Moreover, for a given size of the panels 74, 76, the number of radiating elements is small compared to an active antenna for which the pitch of the array is approximately 0.6λ, which limits the requirements for inspection and cost.

Mechanical pointing of the panel towards the active area limits to ±12° the active area of the diagram in which the signals are transmitted by a panel of radiating elements. In this way, within an area, signals with right circular polarization can be isolated correctly from signals with left circular polarization to achieve a polarization isolation in excess of 20 dB.

Use of a ferrite-based transmit beam-forming network means that the active area of the antenna can be matched to the required pattern.

This always produces a Gaussian pattern and the secondary lobes are at a very low level, regardless of the shape of the diagram and the pointing angle. The isolation between adjacent areas is therefore optimum.

An apodized law is used for transmission and eliminates the secondary lobes, as well as circumventing problems connected with the differential transfer functions of the amplifiers when the latter are operating below their nominal operating point.

What is claimed is:

1. A transmit and receive antenna, for a telecommunications system, for communicating via signals with a target or source area having a position which is variable relative to the antenna, the antenna having a radiation pattern and including, in combination: guide means (80, 82) for pointing the antenna towards the target or source area; and a plurality of radiating elements (74, 76), the antenna being characterized in that the target or source area is of large extent, and in that the radiating elements are associated with power control means for modifying the radiation pattern of the antenna, as a function of the varying relative position of the antenna and the target or source area, to match the pattern to the shape of the target or source area, as seen by the antenna, so as to maintain communication between the target or source area and the antenna regardless of the varying position of the antenna relative to said area.

2. The antenna according to claim 1, wherein the plurality of radiating elements are arranged in separate groups of transmit and receive radiating elements, and wherein said power control means comprises transmit radiating element control means for controlling only the amplitudes of the signals fed to said transmit radiation elements.

3. The antenna according to claim 2, characterized in that said power control means comprises receive radiating element control means for controlling both the amplitudes and the phases of the signals fed to said receive radiating elements.

4. The antenna according to claim 2, characterized in that a plurality of said transmit and receive radiating elements receive signals of a same amplitude.

5. The antenna according to claim 1, wherein said guide means comprises an azimuth motor and elevation motor for pointing the antenna towards said area.

6. The antenna according to claim 1, characterized in that it includes a plate (72) including separate groups of transmit radiating elements (74) and receive radiating elements (76).

7. The antenna according to claim 1, characterized in that the radiating elements (74, 76) are disposed in a geometrical configuration that is optimized for the relative position of the antenna and the target or source area, for which position received ones of the signals are weakest, and for which position transmission requirements for transmitted ones of the signals are greatest.

8. The antenna according to claim 7, characterized in that the radiating elements (74, 76) are disposed on an elongate surface having an elliptical shape.

9. The antenna according to claim 1, characterized in that the power control means includes a ferrite-based transmit beam forming network.

10. The antenna according to claim 1, characterized in that the power control means includes a MMIC-based receive beam forming network.

11. The antenna according to claim 1, wherein the antenna is on a satellite (22), and communicates at all times with an area (26) on the Earth, said area covering several hundred kilometers as the satellite moves over part (24) of the Earth that includes the area.

12. The antenna according to claim 11, wherein said area has an actual shape of a circle, but wherein said area's shape, as seen by the antenna, varies from a circle to an ellipse in accordance with the varying position of said antenna relative to said area, and said radiating elements are arranged in a corresponding elliptical pattern.

13. A method of transmitting and receiving radio signals, using an antenna which has a radiation pattern and which is adapted to communicate with a large target or source area having a position that is variable relative to the antenna, wherein the antenna includes drive means and radiating elements, said method comprising the steps of: pointing the antenna towards the target or source area; and controlling the radiating pattern of the radiating elements in accordance with the relative position of the antenna and the target or source area, so as to match the pattern to a varying shape, of the target or source area, as seen by the antenna.

14. The method according to claim 13, further comprising varying the radiating pattern from a circle to an ellipse, as said area, seen by said antenna, varies from a circle to an ellipse.

* * * * *